United States Patent [19]

Duell et al.

[11] 3,992,898

[45] Nov. 23, 1976

[54] MOVABLE EXPANSION VALVE

[75] Inventors: Richard J. Duell, Syracuse, N.Y.; John A. Ferrel, Tulsa, Okla.

[73] Assignee: Carrier Corporation, Syracuse, N.Y.

[22] Filed: June 23, 1975

[21] Appl. No.: 589,216

[52] U.S. Cl. ..... 62/324; 62/527; 137/513.3; 138/45

[51] Int. Cl.[2] ..... F25B 13/00

[58] Field of Search ..... 137/513.3; 62/511, 222, 62/324, 527, 528; 138/44, 45

[56] References Cited

UNITED STATES PATENTS

| | | | |
|---|---|---|---|
| 2,550,373 | 4/1951 | Ortloff et al. | 137/513.3 X |
| 3,482,415 | 12/1969 | Trask | 62/222 |

*Primary Examiner*—William F. O'Dea
*Assistant Examiner*—Ronald D. Capossela
*Attorney, Agent, or Firm*—J. Raymond Curtin; Thomas J. Wall

[57] ABSTRACT

An expansion device for use in a reversible vapor compression refrigeration cycle for producing, upon demand, either heating or cooling. Two devices are mounted in opposed relationship in a supply line carrying refrigerant between a first heat exchanger and a second heat exchanger. Each expansion device includes a body having a flow passage therein opening into an expanded chamber. A free-floating piston is slidably mounted in the chamber and is moved to a first position when refrigerant is passed through the line in a first direction and to a second position when the direction of flow is reversed. A centrally located metering port passes through the piston while fluted channels are formed in its outer periphery. When in the first position, the fluted channels are closed against one side wall of the chamber and refrigerant is throttled through the metering port from the high pressure exchanger (condenser) into the low pressure exchanger (evaporator). Reversing the direction of refrigerant flow causes the piston to be moved into the second position wherein the fluted channels are opened to the supply line to allow an unrestricted flow of refrigerant about the piston.

5 Claims, 4 Drawing Figures

MOVABLE EXPANSION VALVE

BACKGROUND OF THE INVENTION

This invention relates to a vapor compression refrigeration cycle and, in particular, to an expansion device for throttling refrigerant vapors moving between a pair of heat exchangers which permit the function of the exchangers to be automatically reversed when the cycle operation is changed from a cooling mode to a heating mode.

Normally, in a conventional cooling cycle, slightly superheated refrigerant vapors are discharged from a compressor into a first heat exchanger (condenser) wherein the refrigerant vapors are reduced to a subcooled liquid at a constant temperature. The heat of condensation is rejected from the system into a sink, such as ambient air or the like, and the liquid refrigerant throttled to a lower temperature and pressure. The low temperature refrigerant is then brought through a second heat exchanger (evaporator) in heat transfer relationship with a higher temperature substance to accomplish the desired cooling thereof. Lastly, the evaporate is drawn from the second exchanger by the suction side of the compressor and the cycle is repeated. It has long been recognized that the energy rejected from the cycle during condensation can be used to provide heating.

Typically, to convert the cooling cycle to a "heat pump," the duty of the two heat exchangers is thermodynamically reversed. To achieve this result, the direction of refrigerant flow through the system is reversed by changing the connection between the suction and discharge side of the compressor and the two exchangers, as for example, by repositioning a four-way valve interconnecting the exchangers with the inlet and outlet to the compressor. The cooling condenser now functions as an evaporator, while the cooling evaporator serves as a heating condenser. To complete the thermodynamic reversal, the refrigerant must be throttled in the opposite direction between exchangers. Reversible refrigerant cycles have heretofore generally utilized either a capillary tube or a double expansion valve and bypass system positioned in the supply line connecting the two heat exchangers to accomplish throttling in either direction.

The capillary tube relies upon a fixed geometry to achieve throttling in either direction. The length of the capillary tubes required in a refrigeration system is excessively long and accommodating a tube of this length within the system poses a problem. Secondly, and more importantly, the flow rate that can be supported by a conventional capillary tube is limited. Once the velocity of the refrigerant reaches sonic velocity at the end of the tube, the flow becomes choked. At this time, the flow attains a maximum velocity and the tube will not respond to further changes in inlet or outlet conditions. As a consequence, the usage of a capillary tube in a reversible refrigeration system imposes serious limitation upon the operational range of the system.

In the double expansion valve arrangement, two opposed expansion valves are positioned within the refrigerant supply line extending between the two heat exchangers. A valve operated bypass is also positioned about each expansion valve, which, when the cycle is reversed, is regulated by a relatively complex control network to alternatively utilize one expansion device and bypass the other. The double bypass system thus requires expensive hardware to implement and a complex control network to operate which, because of its complexity, increases the likelihood of a system failure.

SUMMARY OF THE INVENTION

It is therefore an object of the present invention to improve refrigeration systems of the type wherein the cycle is thermodynamically reversible to provide either heating or cooling.

A further object of the present invention is to provide a simple expansion device which will automatically change its function in response to the direction of refrigerant flow to throttle refrigerant flowing in one direction and permit an unrestricted movement of refrigerant in the opposite direction.

Another object of the present invention is to provide an expansion device capable of automatically throttling a metered amount of refrigerant therethrough in one direction and an unrestricted flow of refrigerant in the opposite direction.

Yet another object of the present invention is to improve expansion devices as conventionally utilized in reversible refrigeration systems to meter a required quantity of refrigerant therethrough over a wide range of operating conditions to insure that the refrigerant entering the system evaporator is in a subcooled condition.

These and other objects of the present invention are attained in a refrigeration system having a compressor, a first and a second heat exchanger, a flow reversing mechanism for delivering high pressure refrigerant vapors from the compressor to either one of the exchangers and drawing refrigerant from the other exchanger back into the compressor, a flow metering device positioned in the refrigerant supply line connecting the two exchangers including a body receivable in the line having an axially aligned flow passage therein opening into an expanded chamber coaxially formed with the flow passage, a free floating piston slidably mounted within the chamber adapted to move in response to the direction of flow passing through the chamber between a first and second position, the piston having a series of fluted channels formed in the outer periphery thereof and a central metering port passing therethrough, the fluted passages being arranged to close against one side wall of the expanded chamber when the piston is moved by a flow in a first direction, whereby a metered quantity of refrigerant is throttled through the metering hole, and to open into the refrigerant supply line when the piston is moved by the flow in the opposite direction to permit an unrestricted flow of refrigerant therethrough.

BRIEF DESCRIPTION OF THE DRAWINGS

For a better understanding of the present invention, as well as other objects and further features thereof, reference is had to the following detailed description of the invention to be read in conjunction with the accompanying drawings, wherein.

DESCRIPTION OF THE PREFERRED EMBODIMENT

Figure 1:
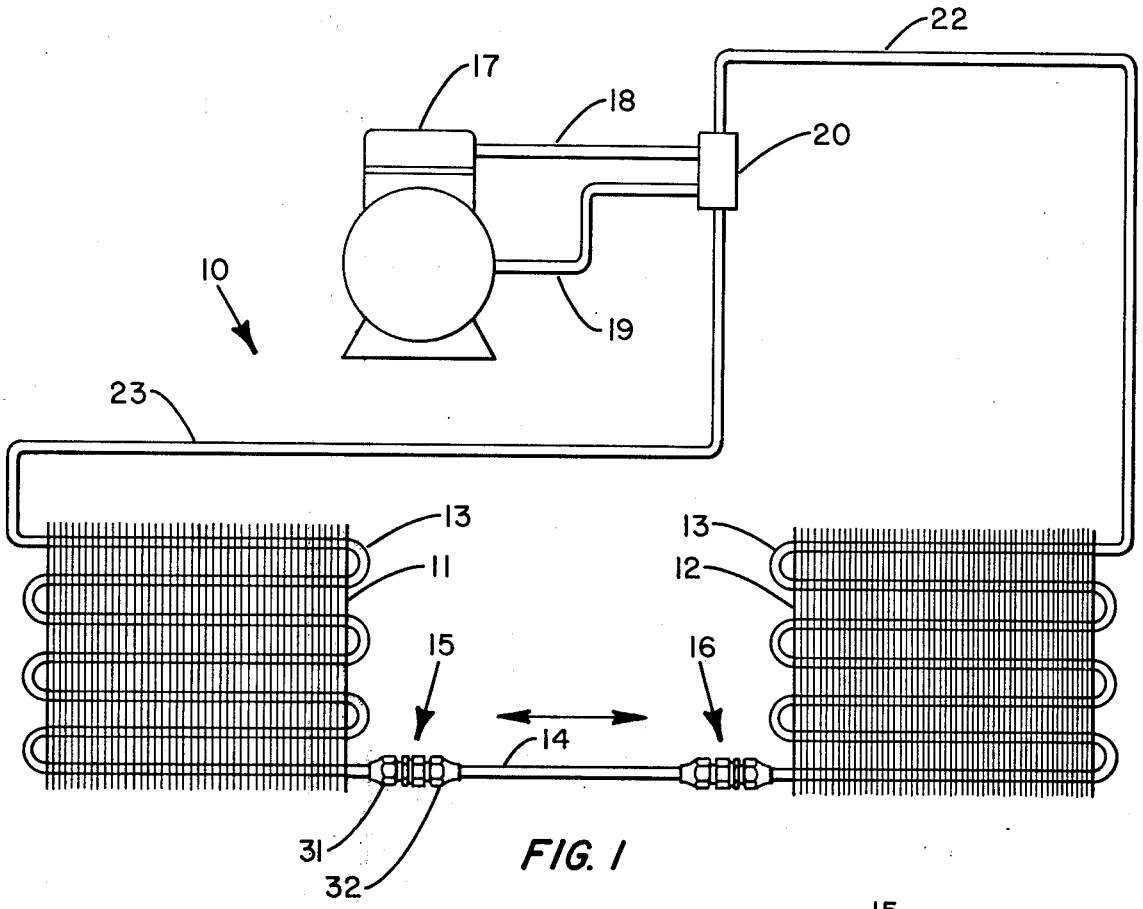
FIG. 1 is a schematic representation of a typical refrigeration system capable of being thermodynamically reversed to provide either heating or cooling, the system containing the expansion device of the present invention.

Referring now to FIG. 1, there is illustrated a typical reversible refrigeration system 10 for providing either heating or cooling. The system basically includes a first heat exchanger unit 11 and a second heat exchanger unit 12, each of which contains a refrigerant coil 13. The coil of each unit is operatively connected to the other by means of a supply line 14 containing a pair of expansion devices 15 and 16 embodying the teachings of the present invention, the function of which shall be explained in greater detail below. A compressor 17, of any suitable type, is arranged so that the discharge piping 18 and the inlet piping 19 thereof are operatively associated with a four-way valve 20. The four-way valve, in turn, is operatively connected to the coil of each exchanger unit via lines 22, 23. By selectively positioning the four-way valve, the connection to the discharge side and suction side of the compressor can be reversed between the exchangers. In a cooling mode of operation, the suction line 19 of the compressor is connected to heat exchanger 12 via line 22 and the discharge line 18 connected to the exchanger 11 via line 23. As a result, heat exchanger 11 functions as a conventional condenser within the cycle, while heat exchanger 12 performs the duty of an evaporator. In the cooling mode, refrigerant passing through the supply line is throttled from the high pressure condenser 11 into the low pressure evaporator 12 in order to complete the cycle.

When the system is employed as a heat pump, the setting of the four-way valve is reversed, thus changing the direction of refrigerant flow, and the function of the two exchangers reversed by throttling refrigerant in the opposite direction. The expansion device of the present invention is uniquely suited to automatically respond to the change in direction of the refrigerant flow moving between the two heat exchangers to provide throttling of refrigerant in the required direction. The expansion device, which is connected directly into the supply line, has the capability of delivering the required amount of flow demanded over an extremely wide range of operating conditions.

It will be noted that two expansion devices 15, 16 are positioned in the supply line extending between the two heat exchangers, each of which functions in an identical manner but are arranged to throttle refrigerant in the opposite direction. Accordingly, a detailed description of only one of these devices is deemed sufficient for purposes of the present disclosure.

Figure 2:
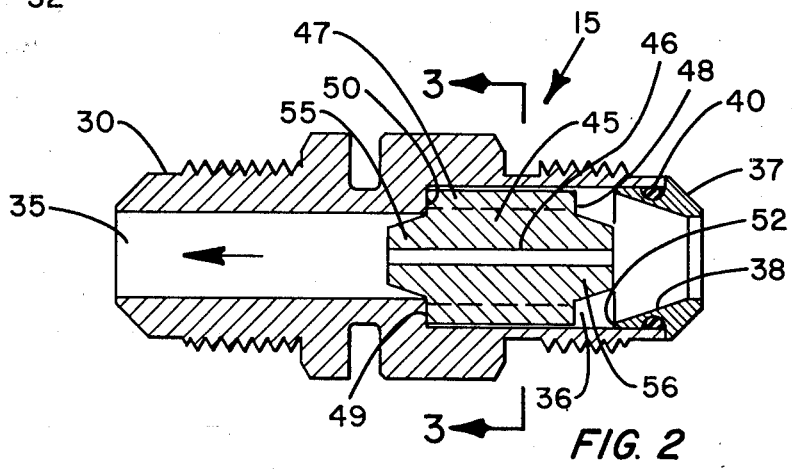
FIG. 2 is a plan view in section of the expansion device employed in the system illustrated in FIG. 1.
Figure 3:
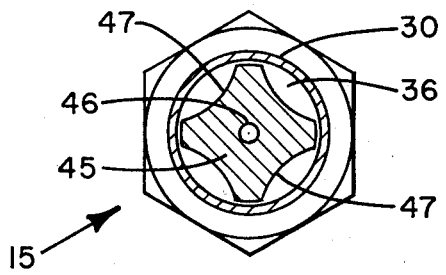
FIG. 3 is a section taken along line 3—3 in FIG. 2, further showing the construction of the expansion device and illustrating the fluted passages formed therein.

As seen in FIG. 2, the expansion device 15 comprises a generally cylindrical housing 30 having a male thread formed at each end thereof which is adapted to mate with female connectors 31, 32 (FIG. 1) associated with the supply line to create a fluid-tight joint therebetween. A flow passage 35, which is axially aligned with the housing body, passes into the body from the left-hand side of the expansion device as viewed in FIG. 2. The diameter of the flow passage is substantially equal to the internal opening contained within the supply line and is thus capable of supporting the flow passing therethrough. The flow passage 35 opens into an expanded annular chamber 36 bored or otherwise machined into the opposite end of the housing body. The open end of the chamber is provided with a nipple 37 which is press-fitted therein and contains a tapered internal opening 38, narrowing down to the diameter of the internal opening of the supply line. An O-ring 40 is carried within an annular groove formed about the outer periphery of the nipple which serves to establish a fluid-tight seal between the internal wall of the expanded chamber and the nipple.

A free-floating piston 45, of special construction, is slidably mounted within the expanded chamber. The piston has a centrally located metering port 46 passing therethrough and a plurality of fluid flow channels 47, which are axially aligned with the metering port, formed in the outer periphery thereof. The piston is of a predetermined length and, in assembly, is permitted to slide freely in an axial direction within the chamber. The piston is provided with two flat parallel end faces 48, 49. The left-hand end face 49, as illustrated in FIG. 2, is adapted to arrest against end wall 50 of the expanded chamber and the right-hand end face 48 adapted to arrest against a flat 52 provided on the internally mounted end of the nipple. The depth of each fluted channel formed within the piston is less than the radial depth of the expanded chamber end wall 50, whereby the flutes are closed when the piston is arrested against the chamber end wall as shown in FIG. 2. On the other hand, when the piston is arrested against the nipple, the fluted channels open directly into the tapered hole passing through the nipple. The combined flow area of the fluted channels is substantially equal to or slightly greater than the internal opening of the supply line whereby the fluted channels are capable of passing a flow at least equal to that accommodated by the supply line.

It should be noted that a truncated cone is carried upon each end face of piston 45. The left-hand cone 55, as seen in FIG. 2, has a circular base at the piston end face 49, possessing a diameter which is slightly less than the internal diameter of flow passage 35. The cone, which is axially aligned with the body of the piston, is positioned within the flow passage when the piston is moved to a metering position, as shown, thereby properly aligning the piston body within the expanded chamber to insure closure of the fluted passages against end wall 50 of the chamber. The right-hand cone 56 has a tapered outer periphery that complements the tapered opening 38 formed within nipple 37. When the piston is moved to the opposite arrested position against the nipple, the cone is positioned within the tapered opening and coacts therewith to provide an annular passage that tapers from a larger diameter at the fluted passages to a smaller diameter at the entrance to the supply line. As a result, the refrigerant flow moving through the fluted passages is directed into the supply line with a minimum amount of turbulence being produced therein.

In operation, the expansion device 15, as shown in FIG. 2, is arranged to throttle refrigerant as it moves as indicated from exchanger 12 into exchanger 11. Under the influence of the flowing refrigerant, the piston is moved to the illustrated position thus closing the fluted channels against the end wall of the expanded chamber whereby the refrigerant is forced to pass through the more restrictive metering port to throttle the refrigerant from the high pressure side of the system to the low pressure side. Similarly, when the cycle is reversed and refrigerant is caused to flow in the opposite direction, the piston is automatically moved to a second arrested position against the nipple. The fluted channels, which are now opened to the tapered hole formed in the nipple, present the path of least resistance to the refrigerant and thus provide an unrestricted flow path around the metering hole through which the refrigerant can freely enter the downstream supply line.

As can be seen from FIG. 1, two expansion devices are positioned within the supply line. The devices are arranged for counteroperation. For example, when refrigerant is flowing from exchanger 12 into exchanger 11 in a cooling mode of operation, the piston of expansion device 15 is automatically moved under the influence of the flow to a closed position to render the fluted channels inoperative whereby refrigerant is throttled through the metering port into exchanger 11. Simultaneously, the oppositely mounted piston in expansion device 16 is automatically moved to an open position to allow an unrestricted flow of refrigerant to move therethrough. Accordingly, when the system is switched to a heating mode of operation, and the direction of flow through the supply line is reversed, the pistons in the two expansion devices are again automatically moved to opposite positions to throttle refrigerant into exchanger 12.

The metering port formed in the free-floating piston represents a fixed geometry expansion device. However, the metering port operates upon a principle that allows the length of the hole, and thus the length of the piston, to be extremely short when compared to other fixed geometry devices such as capillary tubes or the like.

For a better understanding of the operation of the metering hole, the sonic velocity profile of a typical refrigerant will be explained with reference to FIG. 4. As illustrated by the curves 60, shown as a solid line in FIG. 4, the sonic velocity profile of a typical refrigerant exhibits a large discontinuity at the zero quality line. Zero quality, as herein used, refers to the state of the refrigerant when the first vapor bubble forms therein as the refrigerant passes from a subcooled liquid state into a vapor state. As seen from the curve, initially, the sonic velocity of a subcooled liquid refrigerant remains constant as the liquid approaches zero quality. This is depicted graphically as the horizontal curve between state points 1 and 2. Typically, the velocity of the subcooled liquid refrigerant is somewhere around 5,000 feet per second. However, once the first vapor bubble is formed within the liquid, that is, when the quality of the refrigerant first becomes saturated, the sonic velocity of the refrigerant drops drastically to a much lower value typically somewhere around 40 feet per second. State point 3 represents the sonic velocity on the wet mixture side of the zero quality line. As the quality of the mixture increases as more vapor is formed, the sonic velocity of the refrigerant increases gradually as illustrated by the solid line curve 60 extending between state point 3 and state point 4. It should be understood that the graph, for illustrative purposes, is not to scale and the velocity at state point 4 is actually considerably below the sonic velocity of the subcooled liquid. It should be further understood that the sonic velocity, as used in reference to curve 60, represents the speed of sound waves passing through the refrigerant and not the velocity of the flow involved.

Figure 4:
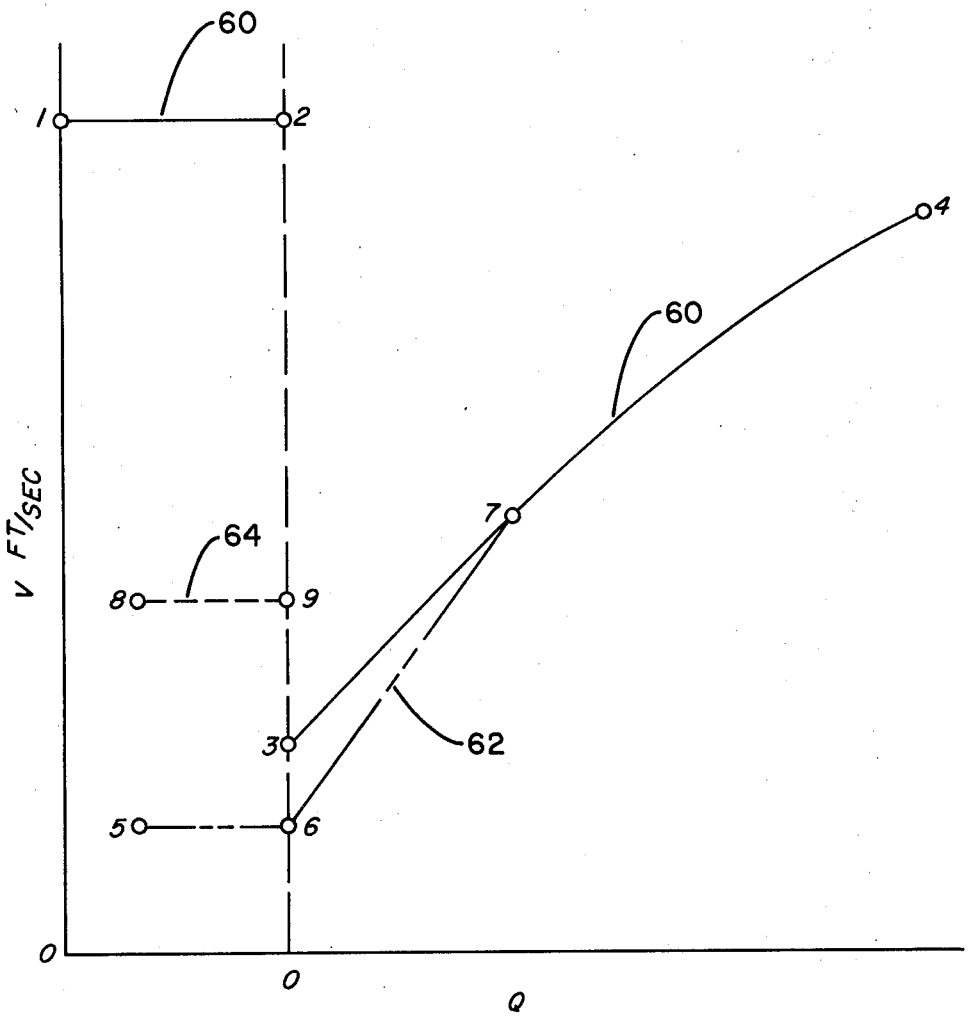
FIG. 4 is a velocity diagram showing the sonic profile of a conventional refrigerant as the state of the refrigerant changes from a liquid to a vapor and comparing this sonic profile with the flow profiles of refrigerant passing through a conventional capillary tube and the metering device of the present invention.

The velocity profile of the typical refrigerant passing through a capillary tube is illustrated by the phantom line curve 62 in FIG. 4. The subcooled flow entering the capillary tube is below both the sonic velocity of the subcooled liquid refrigerant and the sonic velocity of the saturated liquid at zero quality (state point 3). As vapor is formed within the capillary tube, the pressure in the tube decreases causing an increase in the flow velocity. In practice, the flow velocity increases at a faster rate than the sonic velocity of the refrigerant. At some point, state point 7, the two curves intersect. This represents the choke point for the capillary tube which occurs at the end of the tube. If this were not the case, the flow through the tube would have to become supersonic, a phenomena unobtainable in a fixed geometry duct. As can be seen, at this time, the maximum flow through the tube becomes fixed. Furthermore, the choke point cannot move upstream simply because this would create a pressure drop in the capillary tube which again would demand supersonic flows. As a result, the flow is choked at a finite value and the capillary tube cannot accommodate further evaporate demands required by lower evaporator pressures.

The metering port formed in the piston of the present invention is of a fixed geometry, but employs a different principle than that of the conventional capillary tube. The diameter-to-length ratio of the metering port is specifically formed to permit the flow velocity of the subcooled liquid entering the port to be maintained below the sonic velocity of the liquid, but above the sonic velocity for the saturated liquid at zero quality. The velocity profile of the metering port is illustrated by curve 64 shown in dotted lines in FIG. 4. The flow through the metering port remains subsonic as long as the liquid remains subcooled. At the saturation point, however, the refrigerant will immediately go supersonic and remain supersonic because, as discussed above, the velocity of a wet mixture flow increases faster than the sonic velocity of the refrigerant. Therefore, the choke point for the metering port must occur at the zero quality line. Since the choke point can only occur at the end of a fixed geometry duct, the metering port continually functions to pass subcooled refrigerant therethrough regardless of the evaporator pressure. As a result, all flashing of refrigerant takes place immediately outside or downstream of the metering port at some point whereat the pressure in the flow is shocked down to evaporator pressure. As can be seen, if the end of the metering port is reached before the flow is choked, the leaving pressure in the flow must equal the evaporator pressure. If it does not, that is, if the evaporator pressure is lowered, the flow rate is increased automatically until the leaving pressure equals the evaporator pressure. The flow rate is thus automatically regulated or controlled through the expansion device to meet the evaporator demands. It should also be noted that the length of the hole formed within the piston is extremely short and the length of the piston is correspondingly short. As a result, the piston can be supported in a small fitting which can be conveniently connected directly into the supply line as shown in FIG. 1.

While this invention has been described with reference to the structure herein disclosed, it is not confined to the details as set forth in this application, but is intended to cover any modifications or changes as may come within the scope of the following claims.

What is claimed is:

1. In a reversible refrigeration system having a compressor, a first heat exchanger and a second heat exchanger being selectively connected to the compressor, switching means for selectively connecting the inlet and discharge side of the compressor between said exchangers and a refrigerant supply line for delivering refrigerant from one exchanger to the other, the improvement comprising an expansion device mounted in the supply line at the entrance of the supply line to each exchanger having an elongated body coaxially aligned with the supply line and having a central flow passage passing therethrough, the passage opening into an expanded chamber contained within said body, and a free-floating piston slidably mounted within the chamber having a flow metering port passing therethrough for throttling refrigerant and a series of axially aligned channels formed in the outer periphery of the piston, the piston being arranged to move to a first position against one side wall of the chamber when the refrigerant flow passing through the supply line is toward said exchanger entrance wherein the channels are closed against said one side wall of the chamber and refrigerant is throttled through the metering port into said exchanger entrance and to move to a second position when the flow is in the opposite direction wherein refrigerant flows in an uninterrupted manner through said channels into said supply line.

2. The system of claim 1 wherein the metering port is of a diameter and length such that the velocity of refrigerants passing therethrough is in a range above the sonic velocity of saturated refrigerant and below the sonic velocity of liquid refrigerant.

3. The device of claim 1 further including a nipple inserted into the expanded chamber at one end of the body, the nipple having a stop for arresting the piston in said second position and a tapered opening therethrough for directing refrigerant from said channels into said supply line.

4. The system of claim 1 wherein said channels are passages having a combined area equal to or greater than the area of the opening passing through said supply line.

5. The system of claim 3 wherein said piston further includes a first and second axially aligned truncated cone affixed to each end face thereof, said first cone being arranged to enter said flow passage to center said piston therein when the piston is in said first position and said second cone being arranged to enter the tapered opening in said nipple and coact therewith to form an annular passage when the piston is in said second position to direct refrigerant from the channels into said supply line.

* * * * *